US009909744B2

(12) United States Patent
Pontano et al.

(10) Patent No.: US 9,909,744 B2
(45) Date of Patent: Mar. 6, 2018

(54) PORTABLE LIGHTING DEVICES WITH MULTIUSE LANYARDS AND DETACHABLE LANYARDS

(71) Applicant: Industrial Revolution, Inc., Tukwila, WA (US)

(72) Inventors: Peter Pontano, Seattle, WA (US); Colin Quinn, Seattle, WA (US); Graeme Esarey, Seattle, WA (US); Jami Odell, Seattle, WA (US)

(73) Assignee: Industrial Revolution, Inc., Tukwila, WA (US)

( * ) Notice: Subject to any disclaimer, the term of this patent is extended or adjusted under 35 U.S.C. 154(b) by 35 days.

(21) Appl. No.: 14/986,692

(22) Filed: Jan. 3, 2016

(65) Prior Publication Data

US 2016/0223172 A1 Aug. 4, 2016

Related U.S. Application Data

(60) Provisional application No. 62/099,637, filed on Jan. 5, 2015.

(51) Int. Cl.

| | |
|---|---|
| ***F21V 21/08*** | (2006.01) |
| ***F21V 21/14*** | (2006.01) |
| ***F21V 21/096*** | (2006.01) |
| *F21L 4/00* | (2006.01) |

(52) U.S. Cl.

CPC ..... *F21V 21/0816* (2013.01); *F21V 21/0965* (2013.01); *F21V 21/145* (2013.01); *F21L 4/005* (2013.01)

(58) Field of Classification Search

CPC ... F21L 14/02; F21L 15/14; F21L 4/00; F21L 4/005; F21S 8/06; F21V 14/025; F21V 21/08; F21V 21/0816; F21V 21/0832; F21V 21/0965; F21V 21/16; F21V 21/18; F21V 23/0421; F21V 21/145

See application file for complete search history.

(56) References Cited

U.S. PATENT DOCUMENTS 2,361,414 A * 10/1944 Ramsey ..... B63C 9/20 362/108
3,550,824 A * 12/1970 Bohanski ..... F21V 21/08 224/197
4,740,874 A * 4/1988 Wylie ..... F21L 15/04 362/187

(Continued)

FOREIGN PATENT DOCUMENTS

GB 2530279 A * 3/2016 ..... G08B 5/002

*Primary Examiner* — Hargobind S Sawhney
(74) *Attorney, Agent, or Firm* — DWC Law Firm, P.S.; David Chen

(57) ABSTRACT

Apparatus and methods for attaching portable lighting devices to objects/surface are provided. In some embodiments, an elastic lanyard is anchored to a body portion of a portable lighting device and a free closed loop portion can be looped around an object, and/or a channel formed on the body portion. In some embodiments, the channel is formed on a base of the body portion and the elastic lanyard can be stretched about an object disposed between a bottom surface of the base and the lanyard. In other embodiments, a lanyard is anchored to a detachable member that is magnetically attachable to a body portion of the portable lighting device.

5 Claims, 10 Drawing Sheets

(56) References Cited

U.S. PATENT DOCUMENTS

| | | | | | |
|---|---|---|---|---|---|
| 5,416,685 | A * | 5/1995 | Myers | F21L 14/02 | 362/260 |
| 5,510,963 | A * | 4/1996 | Bamber | F21L 15/14 | 362/190 |
| 5,593,074 | A * | 1/1997 | Matthews | A45F 5/02 | 224/195 |
| 5,642,932 | A * | 7/1997 | Matthews | F21V 23/0421 | 362/202 |
| 6,916,104 | B2 * | 7/2005 | Parsons | F21L 4/005 | 362/109 |
| 6,953,259 | B2 * | 10/2005 | Parsons | F21V 21/0885 | 362/191 |
| 7,226,190 | B2 * | 6/2007 | Petzl | F21V 5/045 | 362/157 |
| 8,430,529 | B2 * | 4/2013 | Christ | F21L 4/08 | 362/183 |
| 2006/0018114 | A1 * | 1/2006 | Gorrie | A45C 13/30 | 362/190 |
| 2006/0171142 | A1 * | 8/2006 | Abel | F21V 23/0414 | 362/157 |
| 2006/0291198 | A1 * | 12/2006 | Dalton | F21L 4/005 | 362/191 |
| 2012/0275143 | A1 * | 11/2012 | Robinson | F21L 4/005 | 362/184 |
| 2013/0215608 | A1 * | 8/2013 | Killion | F21L 4/027 | 362/198 |
| 2013/0301242 | A1 * | 11/2013 | Sharrah | F21V 21/084 | 362/105 |

* cited by examiner

PORTABLE LIGHTING DEVICES WITH MULTIUSE LANYARDS AND DETACHABLE LANYARDS

CROSS REFERENCE TO RELATED APPLICATION(S)

This application claims the benefit of U.S. Provisional Patent Application No. 62/099,637, filed Jan. 5, 2015, which is incorporated herein by reference in its entirety.

BACKGROUND

1. Technical Field

The present disclosure relates to portable lighting devices, and in particular, to lanterns, flashlights, and combination flashlight/lanterns having flexible and/or elastic multiuse lanyards.

2. Description of Related Art

Closed loop attachment lanyards are commonly provided as anchored attachment members on portable lighting devices (e.g., lanterns and flashlights) since they provide a convenient manner in which to attach the lighting device to an object/surface when a termination end of the object/surface is easily accessible (e.g., looping a lanyard over a user's wrist). However, such attachments are not convenient for a variety of situations. For example, if a termination/end point of the object/surface is not easily accessible (e.g., a long tree branch), in order to hang the lighting device using the anchored closed loop lanyard, the user would need to either tie the lanyard, or loop the lanyard though itself, both of which methods of attachment can be impossible or impractical, given that the lanyard is anchored to the lighting device. Moreover, even if the lanyard and lighting device are attached by tying to the object/surface, it is frequently inconvenient if the lighting device needs to be removed and reattached frequently to the object/surface.

BRIEF SUMMARY

In some embodiments of the present disclosure, a portable lighting device comprises a light source; a body having a base and a lens or globe; a flexible and/or elastic lanyard anchored to the body of the portable lighting device; and a channel formed on the body, the channel being configured to receive and retain a portion of a free closed loop of the elastic lanyard, with the elastic lanyard being stretched under tension. The elastic lanyard can be fixedly anchored to the base, and the base can have one or more notches disposed on a bottommost surface thereof, wherein the one or more notches and lanyard are configured such that a portion of the lanyard can be stretched from the based and upward onto the body to be attached to the channel, while clearing the bottommost wall of the base by being recessed into the one or more notches, so as to avoid interference with the base resting on a surface (e.g., during storage of the lanyard on the lighting device). On the other hand, the fixed anchor point of the lanyard on the base can provide convenient functionality for use in attaching the base to an object, by stretching the free closed loop of the elastic lanyard around an object, and then attaching it to the channel to secure the base to the object, with or without, a conveniently accessible termination point of the object/surface being available.

In some embodiments, the channel is formed around at least a portion of a frame that rises, or otherwise transversely extends, from an outer sidewall of the base. Also, a power button can be disposed on the frame.

In some embodiments, a rigid ring can be formed on the body of the portable lantern, and the elastic lanyard can be fixedly or detachable anchored to the body at the rigid ring. Moreover, in some embodiments, the channel for receiving the free closed loop portion of the lanyard is not formed on a frame member of the power button, such as in the embodiments described above, but instead, the channel is formed between a rigid tab extending from an outer sidewall of the body and a sidewall of the body.

In some embodiments, a portable lighting device comprises a light source; a body having a base and a lens or globe; and a flexible and/or elastic lanyard anchored to a detachable member, the detachable member being magnetically attachable to at least a section of the body. The detachable member can be magnetically attachable to a bottom surface section of the base. Also, the elastic lanyard can extend from the detachable member in closed loop fashion.

In some embodiments, a bottommost surface of the base extends below the bottom surface section to which the detachable member can be magnetically attached. As such, in some embodiments, when the detachable member is attached to the bottom surface section, it can clear a surface upon which the base can rest (this can avoid contact of the detachable member against a resting surface when it is attached to the base, to avoid inadvertent displacement of the detachable member). Moreover, the detachable member can be easily attached to, or hung from, an object by the lanyard fixedly attached to the detachable member. The detachable member can be typically smaller than the body of the lighting device (¼th-1/20th, or less, the volume of the body of the lighting device) and can be easily manipulated for tying or connecting the detachable member to the object/surface, and then the body portion of the portable lighting device can be conveniently and selectively attached or detached from the detachable member to retain the portable lighting device to the object.

BRIEF DESCRIPTION OF SEVERAL VIEWS OF THE DRAWINGS

FIG. 6*c* is a simplified front elevation view of the portable lighting device of FIG. 6*a*, with the globe in an extended position, whereas FIG. 6*a* depicts the globe in a retracted position.

DETAILED DESCRIPTION

In the present description, where used, the terms "about," or "approximately" mean±20% of the indicated range, value, or structure, unless otherwise indicated. It should be understood that the terms "a" and "an" as used herein refer to "one or more" of the enumerated components. The use of the alternative (e.g., "or") should be understood to mean either one, both, or any combination thereof of the alternatives, unless expressly stated otherwise. As used herein, the terms "include" and "comprise" are used synonymously, and those terms and variants thereof are intended to be construed in a non-limiting, open sense.

In the present description, certain specific details are set forth in order to provide a thorough understanding of various embodiments of the present disclosure. However, upon reviewing this disclosure, one skilled in the art will understand that the invention may be practiced without many of these details. In other instances, well-known or widely available structures associated with lanterns or flashlights, or flexible and/or elastic chords or lanyards, have not been described in detail to avoid unnecessarily obscuring the descriptions of the embodiments of the present disclosure. Various embodiments of the present disclosure are described herein by way of example only, in the context of use with flashlights, lanterns and/or combination lantern/flashlights. However, as those skilled in the art will appreciate upon reviewing this disclosure, the present disclosure may also have a plethora of other types of applications with other portable devices, and such applications are contemplated herein. Unless otherwise expressly stated, when an example is presented herein, such as in each of the drawings of the present disclosure, it is intended to be non-limiting.

Figure 1:
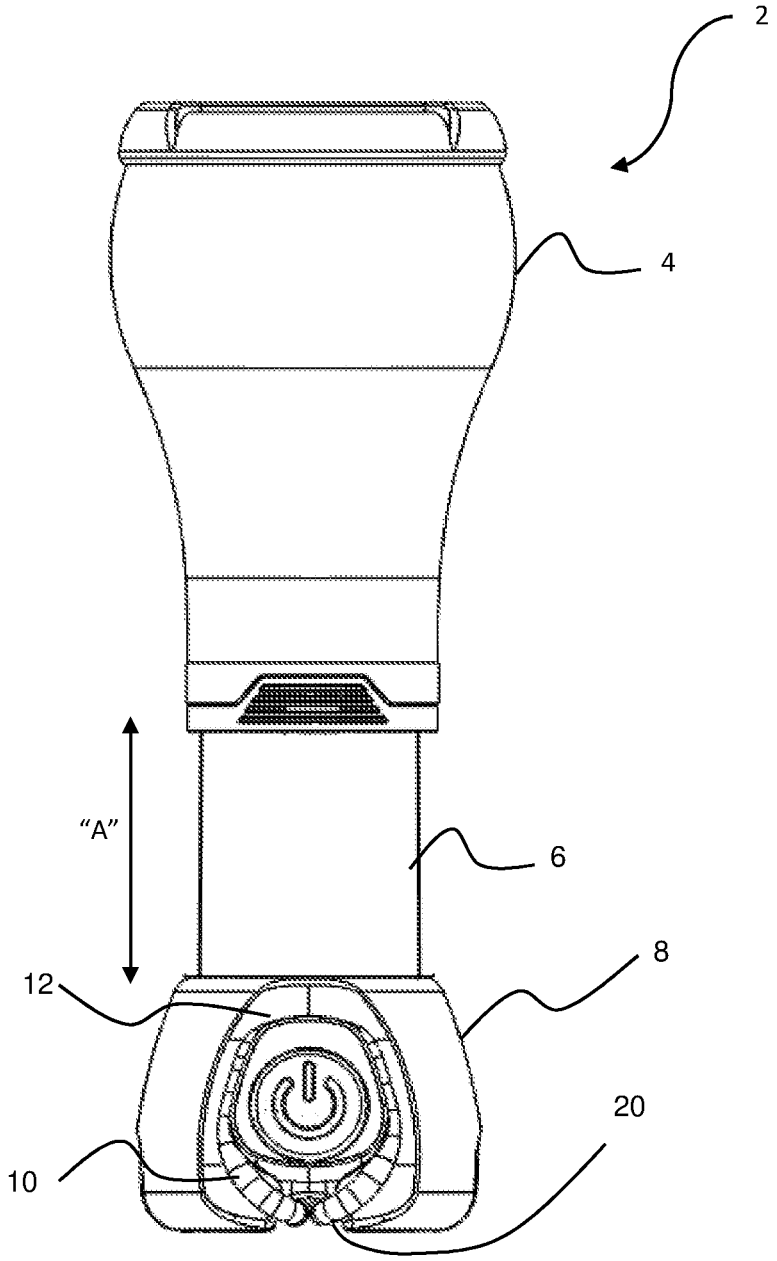
FIG. 1 is a perspective view of an embodiment of a portable lighting device of the present disclosure having a translucent (or transparent) globe containing a light source, placed in an extended position.
Figure 2:
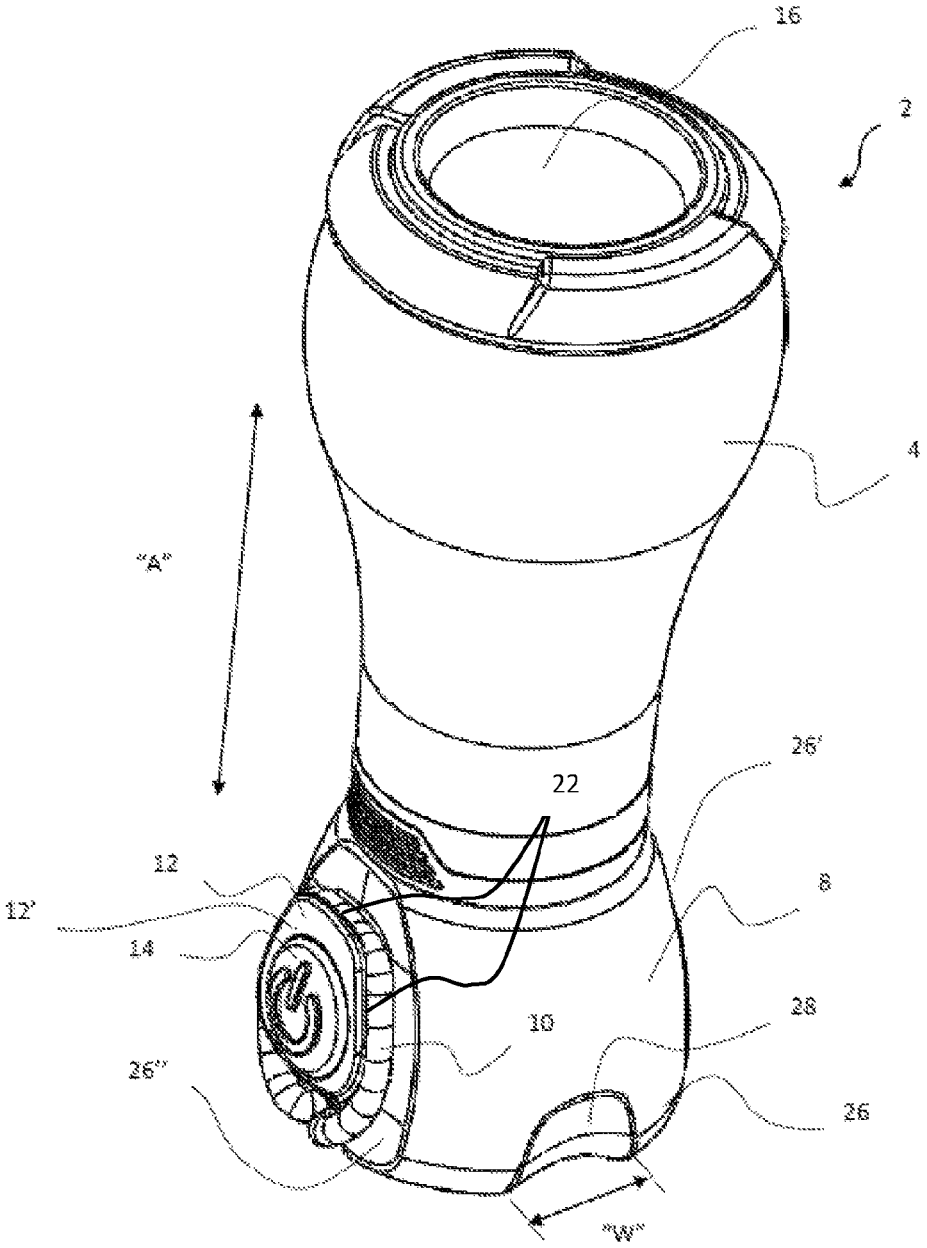
FIG. 2 is a perspective view of the portable lighting device of FIG. 1, showing the globe in a retracted position.

Referring to FIGS. 1 & 2, in some embodiments of the present disclosure, a portable lighting device 2 is provided, which can be, for example, without limitation, a lantern, flashlight, or a combination lantern/flashlight. The lighting device 2 can have a light source (not illustrated) positioned near a top portion of a neck member 6, such as, for example, an LED light source. The light source can be shielded by a translucent member, such as, a lantern globe 4 (as used herein, "translucent" can refer to transparent or non-transparent material characteristics that are capable of permitting the passage of light). The globe 4 can be coaxially slidably attached to a neck member 6, so as to be vertically slidable along a longitudinal axis of the portable lighting device, in the directions illustrated by arrow "A" in FIGS. 1 & 2, to an extended position, such as shown in FIG. 1, or a retracted position, such as shown in FIG. 2. When placed in a retracted position, a lens 16, disposed proximate an end portion of the globe 4, can be positioned proximate the light source (See, FIG. 2), as opposed to a spaced-apart position of the lens 16 from the light source when the globe 4 is in an extended position (See, FIG. 1). When placed in the retracted position (e.g., as shown in FIG. 2), all or part of the globe 4 is vertically aligned with the neck 6 so as to obscure or block light from the light source, from passing through all or part of the globe 4, and simultaneously increasing the intensity of light passing through the lens 16, (relative to the intensity of light passing through the lens 16 when the globe 4 is in the extended position).

Figure 3:
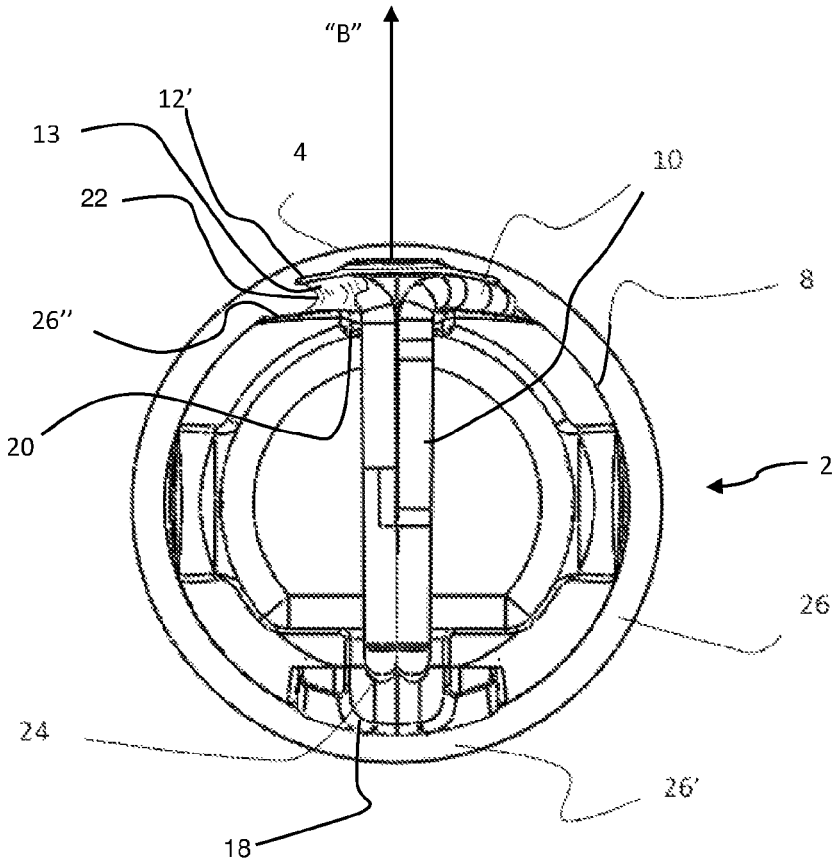
FIG. 3 is a bottom plan view of the portable lighting device of FIG. 1, showing a partial cutaway view of the lanyard on the left side thereof, to reveal a channel on the button frame which extends to a top portion of the button frame as shown in FIG. 2, in which the lanyard can be tucked for retaining the lanyard under tension.
Figure 4:
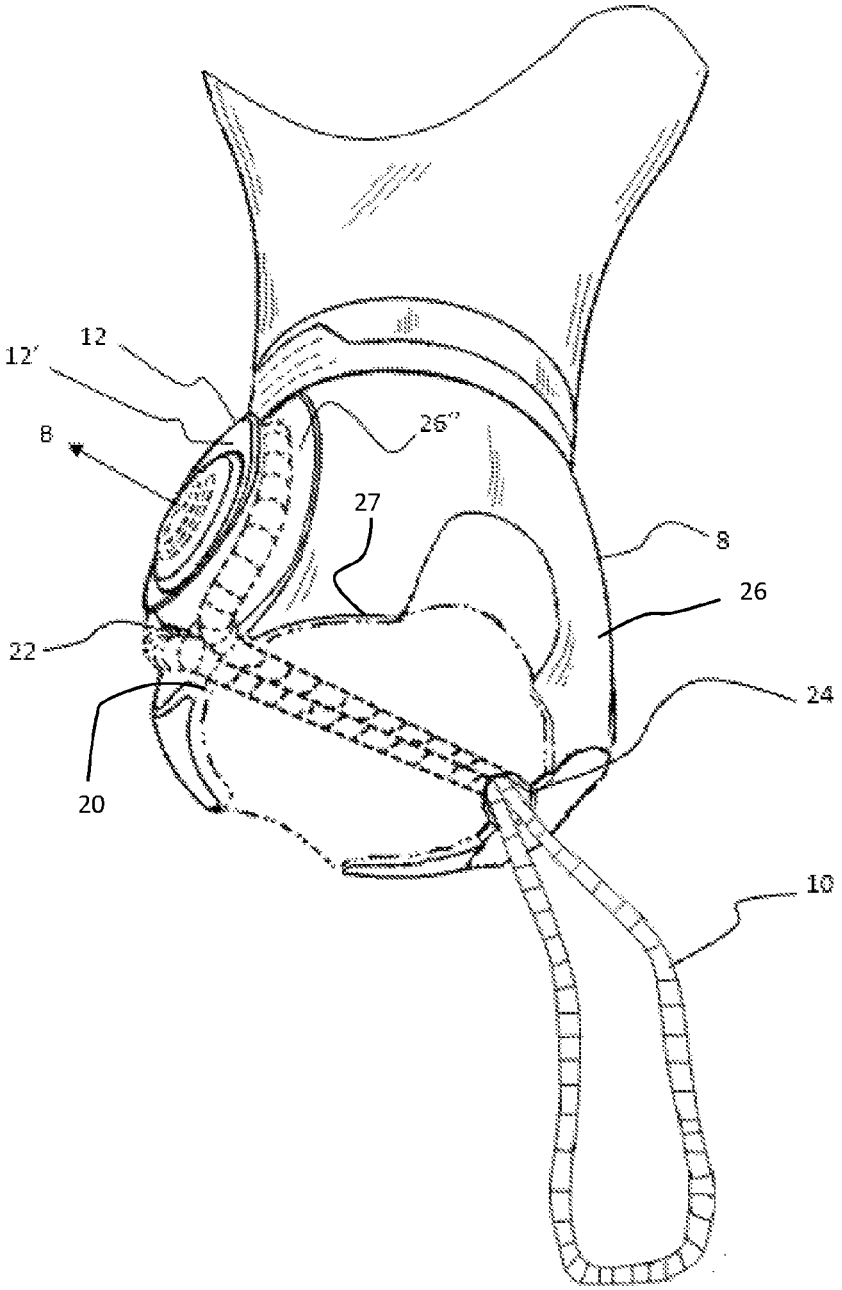
FIG. 4 is a partial bottom perspective view of the portable lighting device of FIG. 1, showing a free hanging position of the lanyard, and an alternate tensioned position of the lanyard in broken line with a free end portion of the lanyard looped about a channel on the button frame member.

Referring to FIGS. 3 & 4, in some embodiments, a lanyard 10 is fixedly attached to an anchor section 24 positioned near a bottom portion of a base 8 of the lighting device 2, on a rearward portion 26' of a sidewall 26 thereof. The lanyard 10 can be flexible and/or elastic, and form a closed loop extending outward from the anchor section 24.

In some embodiments, the base 8 is formed with a power button frame 12, which rises in a transverse, or radial direction from a surrounding portion of the front portion 26" of the sidewall 26 of the base 8. The frame 12 has a front facing surface 12' which surrounds a power button 14 (for use in activating the light source).

Referring to FIGS. 3 & 4, in some embodiments, a channel 22 is provided around a perimeter of the frame 12. In particular, as the frame 12 rises in the radial direction "B" (transverse to the longitudinal axis of the portable lighting device 2) from the front portion 26" of the sidewall 26, a sidewall 13 of the frame 12 slopes away from the radial direction to define a channel 22 between the front facing surface 12' of the frame 12 and the front portion 26" of the base 8. Alternatively, in some embodiments, sidewall 13 rises in parallel with the radial direction "B," then extends transversely therefrom to define the channel 22 between the front portion 26" and the sidewall 13 and/or front facing surface 12'.

In some embodiments, the channel 22 extends about the entire perimeter of the frame 12, while in other embodiments, the channel 22 extends only partially about the frame 12, or alternatively, one or more channels can be provided that each extend partially about the frame 12, as will be appreciated by those skilled in the art after reviewing this disclosure. Referring to FIG. 2, in some embodiments, the channel 22 exists on both vertically extending side portions of the frame and on a top portion of the frame 12.

Referring to FIGS. 1 & 3, in some embodiments of the present disclosure, the sidewall 26 of the base 8 can include notches 18, 20 that define recesses that rise vertically from a bottommost surface of the sidewall 26, relative to the longitudinal axis "A" of the portable lighting device 2. The perimeter of the notches 18, 20 can be approximately semi-circular in shape in some embodiments. A rearward notch 18 can be positioned near the anchor section 24 of the lanyard 10, and a front notch 20 can be positioned proximate, and aligned below, the power button frame 12. Referring to FIGS. 2, 3 & 4, the lanyard 10 can be retained in a "tucked" position (See, e.g., FIGS. 3 & 4) by selectively extending or stretching the lanyard 10 from the anchor section 24, to which the lanyard 10 can be fixedly attached, through the notches 18, 20 so as to rest in an upwardly recessed position above the bottommost surface 27 of the sidewall 26, and looping a closed loop end portion of the lanyard 10 about the frame 12 to rest within the channel 22. In some embodiments, the lanyard 10 is selectively configured and/or sized such that it exerts elastic tension against an inside wall of the channel 22, and against surfaces of the notches 18, 22, to retain the lanyard 10 in the tucked position. In the tucked position, the base 8 of the portable lighting device 2 can be placed on a surface, such that the portable lighting device 2 stands upright (See, e.g., FIG. 1), without interference at the bottom of the base 8 by the lanyard 10, since it is recessed into the notches 18, 20. Also, the lanyard can be untucked at any time to be used as an elastic anchor which can be looped about a secure point, such as, for example, a user's wrist.

Figure 5:
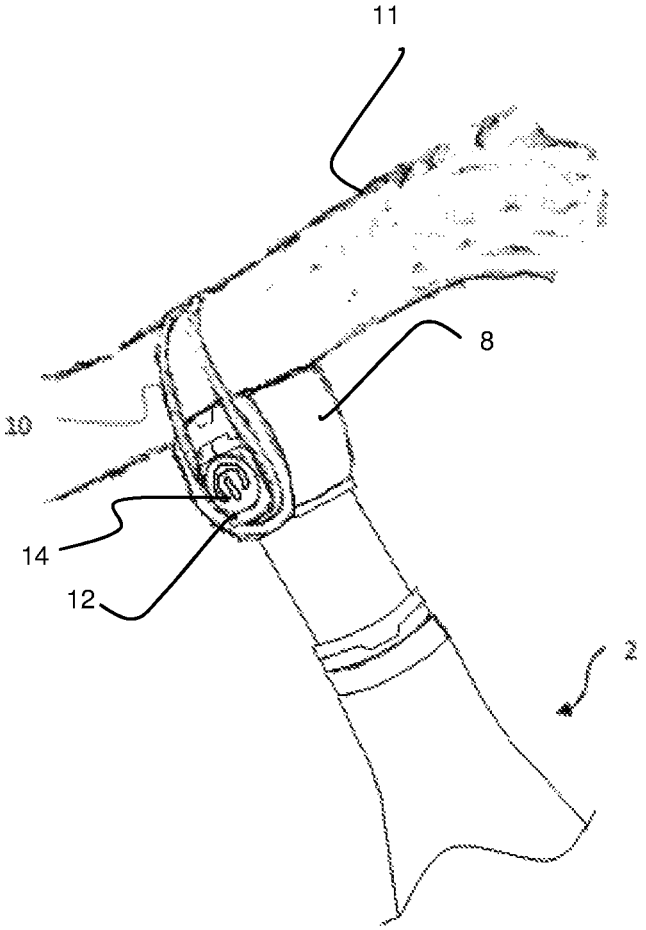
FIG. 5 is a partial perspective view showing the portable lighting device of FIG. 1 attached to a tree branch by a lanyard that is attached to a base portion of the portable lighting device, wrapped about the tree branch, and looped about a channel on a button frame member of the portable lighting device under tension.

In other embodiments, the lanyard 10 can be tucked within the channel 22, but not necessarily the notches 18, 20, to secure the portable lighting device to an object that does not have an accessible, or conveniently accessible, termination point. That is, in various conventional type lanterns, for example, a hook having an open configuration, rather than closed loop, is provided so that the lantern can be hung from an object that does not have an accessible termination point. However, the present disclosure provides a multiuse lanyard configuration, which can be used by tucking the lanyard 10 in the channel 22, as shown in FIG. 5. In particular, the lanyard 10 can be elastically stretched about an object 11 placed against the bottom of the base 8, with the end portion of the lanyard 10 looped about the frame 12 and tucked in the channel 22, to securely retain the portable lighting device 2 to the object 11, because the lanyard 10 exerts tension against the object 11 (e.g., a tree branch, backpack strap, or other object, etc.) and the portable lighting device 2. As will be appreciated by those skilled in the art after reviewing this disclosure, in other embodiments, the object 11 can be positioned against a side portion of the of portable lighting device 2, in which case, the lanyard 10 can extend outward from a side of the portable lighting device 2, to be wrapped about the object, and again, looped about the frame 12, within the channel 22, to securely retain the portable lighting device against the object. This convenient manner of attachment allows a closed loop lanyard to be used while alleviating a struggle of needing to pass the entire lighting device 2 (See., e.g., FIG. 5) through the lanyard loop in order to attach it to the object 11 (where no termination point is easily accessible), as will be appreciated by those skilled in the art after reviewing this disclosure.

Referring to FIG. 2, in some embodiments, one or more recesses 28, having maximum width "W," are provided on a sidewall of the base 8, or any of a variety of other locations on the portable lighting device 2, wherein the width "W" is a maximum lateral distance between perimeter portions of the recess. The recess 28 can be particularly useful in some embodiments, such as, by being positioned on a side of the base 8, because the lateral cross section of the base 8, or other portions of the portable lighting device 2, can be circular in shape, and the recess can help stabilize the portable lighting device 2 against an object. For example, if an object is placed against the portable lighting device 2, with a portion of the object extending into the recess 28, the recess 28 can assist in stabilizing the portable lighting device 2, with the lanyard elastically wrapped about the object and secured within the channel 22, as will be appreciated by those skilled in the after reviewing this disclosure.

In some embodiments, a width "W" of the recess is, for example, without limitation, equivalent to about one sixth (⅙) to one half (½) of a maximum diameter of the base 8. In some embodiments, the width "W" is equivalent to about one half (½) to three fourths (¾) of a maximum diameter of a base 8, or about one fourth (¼) to one third (⅓) of a maximum diameter of the base 8.

Figure 6A:
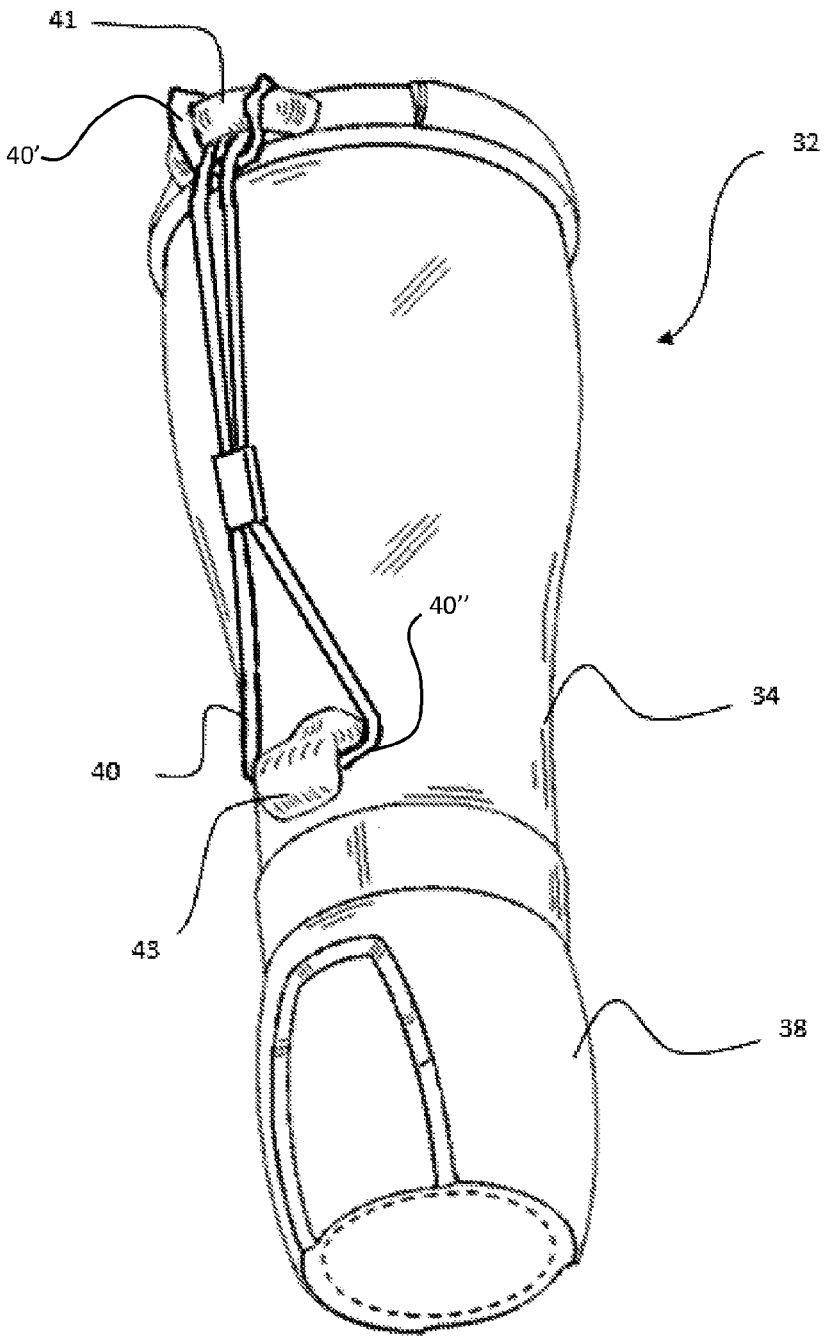
FIG. 6*a* is a perspective view of an alternative embodiment for a portable lighting device of the present disclosure, showing an elastic lanyard connected to a rigid ring on a globe of the portable lighting device, as well as a rigid tab, with the lanyard under tension.
Figure 6B:
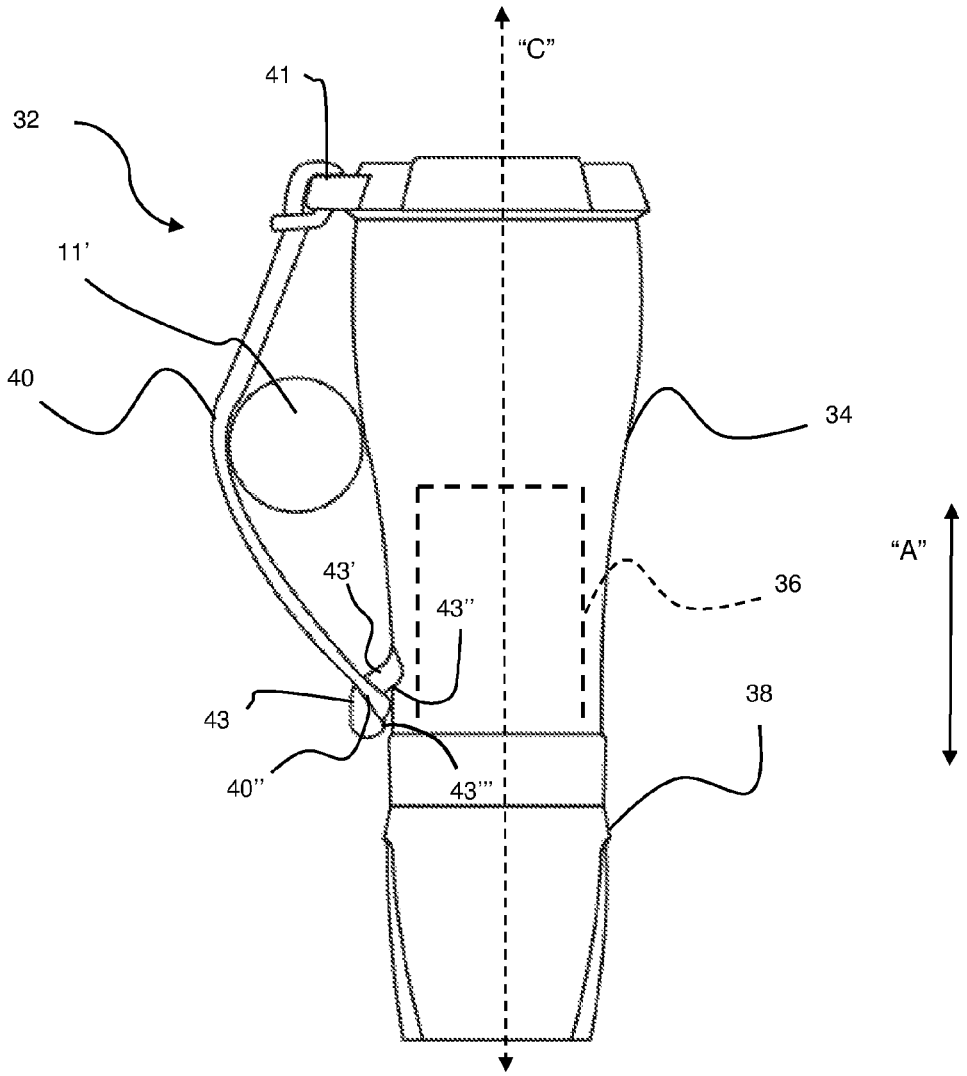
FIG. 6*b* is a simplified side elevation view of the portable lighting device of FIG. 6*a*, further showing the portable lighting device attached to an object for retaining the portable lighting device thereon.
Figure 6C:
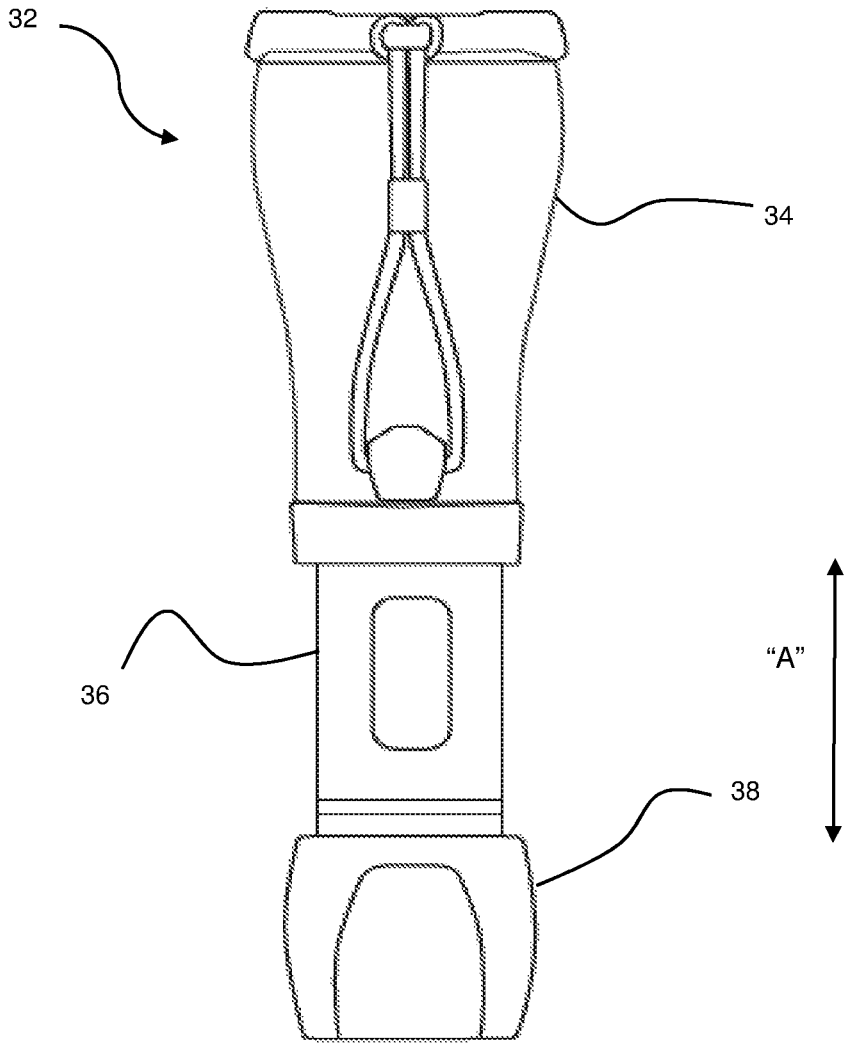

Referring to FIGS. 6*a*, 6*b*, & 6*c*, in an alternative embodiment of the present disclosure, a portable lighting device 32, such as, for example, combination flashlight/lantern, or lantern, or flashlight, includes a translucent lantern globe 34, which is vertically slidable in the direction illustrated by arrow "A'" along a concentrically disposed vertically extending neck portion 36, between a retracted position (e.g., FIGS. 6*a* & 6*b*) and an extended position (e.g., FIG. 6*c*). A light source (not illustrated) can be disposed within the globe 34, such as, for example, an LED light source disposed on a top section of the neck portion 36. The neck portion 36 can be integrally formed with, or otherwise attached on, a base 38, and in some embodiments, when the globe 34 is retracted, the globe 34 is positioned at a top of the base 38, as shown in FIGS. 6*a* & 6*b*. A power actuation button or knob (not illustrated) can be provided for the light source on the base 38.

In some embodiments, a rigid semiring or rigid loop 41 is disposed on the globe 34, such as, for example, on a top portion thereof. Also, a rigid tab 43 can also be disposed at a location on the globe 34 that is spaced apart from the rigid loop 41, such as, for example, on a bottom portion of the globe 34. A lateral portion 43' of the rigid tab 43 can extend transversely outward, relative to a vertical longitudinal axis "C" of the portable lighting device 32. In some embodiments, the lateral portion 43', can have an outwardly downwardly sloping downward facing surface 43". Moreover, in some embodiments, the rigid tab 43 can include a substantially vertical inside facing sidewall 43', forming a channel between the sidewall 43" and a sidewall of the body of the portable lighting device.

A flexible and/or elastic closed loop lanyard 40 can be attached to the rigid loop 41 by, for example, threading the closed loop lanyard 40 through the rigid loop 41 so that a part of the closed loop lanyard 40 extends from either side of the ridge loop 41, and then threading a section of the closed loop lanyard 40 on either side of the rigid loop 41 through itself, on the other side of the rigid loop 41, to a form an overlapping loop connection 40'. Thereafter, a free portion 40" of the closed loop lanyard 40 can be pulled downward manually to be looped below the rigid tab 43, or within the channel formed between the sidewall 43'" and a body surface (e.g., surface of the globe) of the portable lighting device. In some embodiments, the closed loop lanyard 40 is sized and/or configured to be under tension when connected at the rigid loop 41, with a free portion 40" having been pulled downward to be looped below the ridge tab 43, to retain the free portion 40" below the rigid tab 43, and inward of the inside facing sidewall 43'" thereof (in a tensioned position).

Referring to FIG. 6*b*, in some embodiments, a user can leave the free portion 40" unattached to the rigid tab 43 when the placing the portable lighting device 32 against an object 11', and then can pull the lanyard 40 over the object 11' to attached the free portion 40" to the rigid tab 43 (as described above), with the lanyard 40 in a tensioned position with the object 11' disposed between the globe 34 and the lanyard 40. Similar to that described above for the embodiment shown in FIG. 1, the lanyard 40 can thus be used to attach the portable lighting device 32 to an object 11' that does not have a conveniently accessible termination point, and alternatively, a free section of the closed loop lanyard 40 can also be simply slipped looped over a termination point of an object (e.g., threading the object through the loop on the lanyard 40) if the object has a conveniently accessible termination point and is of a diameter that fits within the lanyard 40. Moreover, as will be appreciated by those skilled in the art, in some embodiments, a user can store the portable lighting device 32 with the lanyard 40 tensioned about an object 11', such as, for example, if the object 11' is a closed strap on a backpack or other carrying device. Alternatively, the user can attach the portable lighting device 32 to any object 11' during use, such as, for example, if the object 11' is a tree branch.

In some embodiments of the present disclosure, a combination of lanyard attachment features can be provided combining the examples illustrated in FIGS. 1-6*c*. For example, a combination embodiment can have a globe 34 with lanyard 40 stored under tension against its globe 34, by rigid ring 41 and rigid tab 43, and could also have a base 8 with button frame member 12 on a base 8 thereof, with lanyard 10 anchored to the base 8 and stored under tension by being wrapped about channel 22. Such a combination embodiment provides multiple alternative lanyard attachment configurations.

Figure 7:
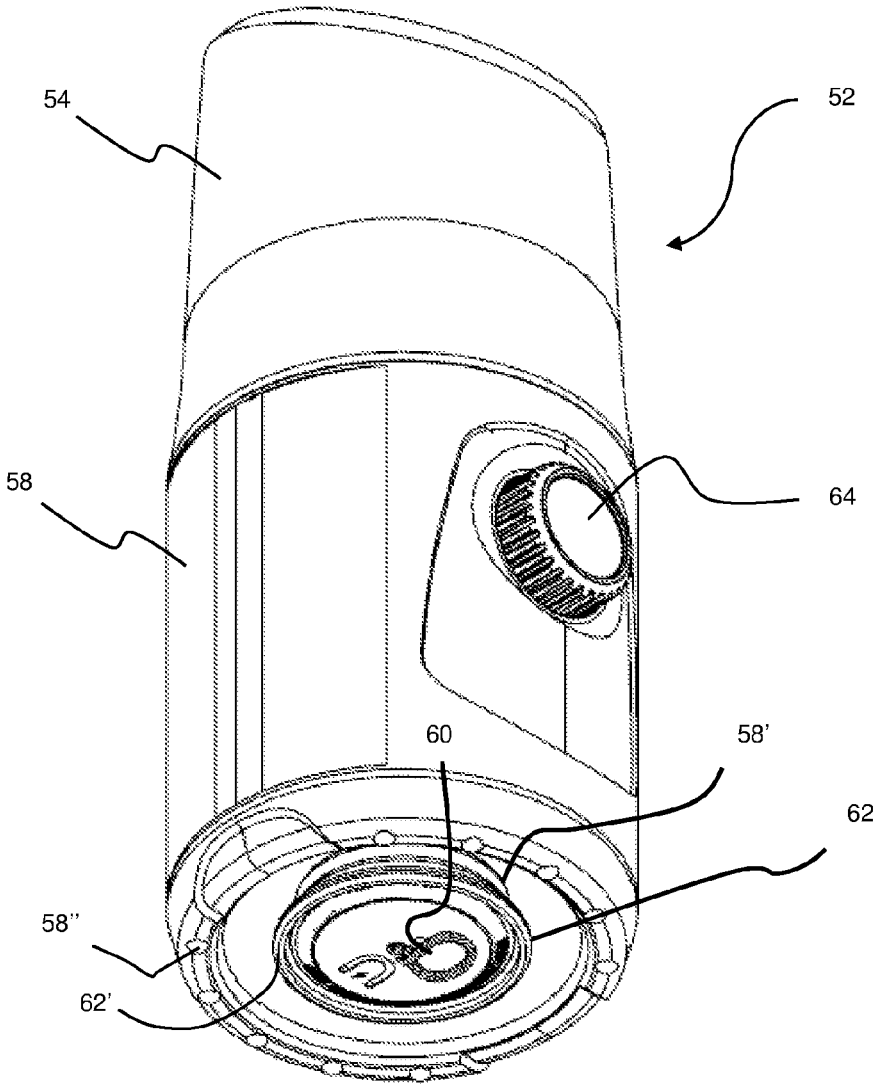
FIG. 7 is a perspective view of an alternative embodiment for a portable lighting device of the present disclosure having a disc-like magnet member detachably connected to a bottom surface section of the portable lighting device.
Figure 8:
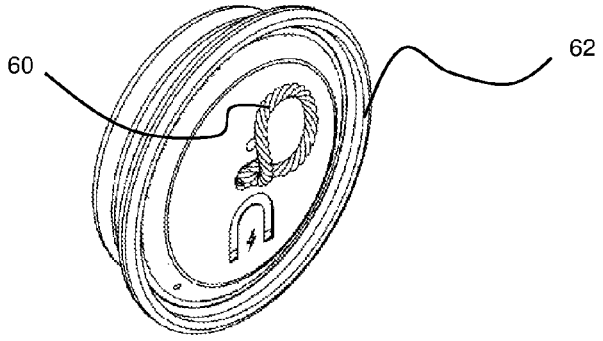
FIG. 8 is a perspective view of the magnet member of FIG. 7, illustrated as being detached from a body of the portable lighting device.
Figure 9:
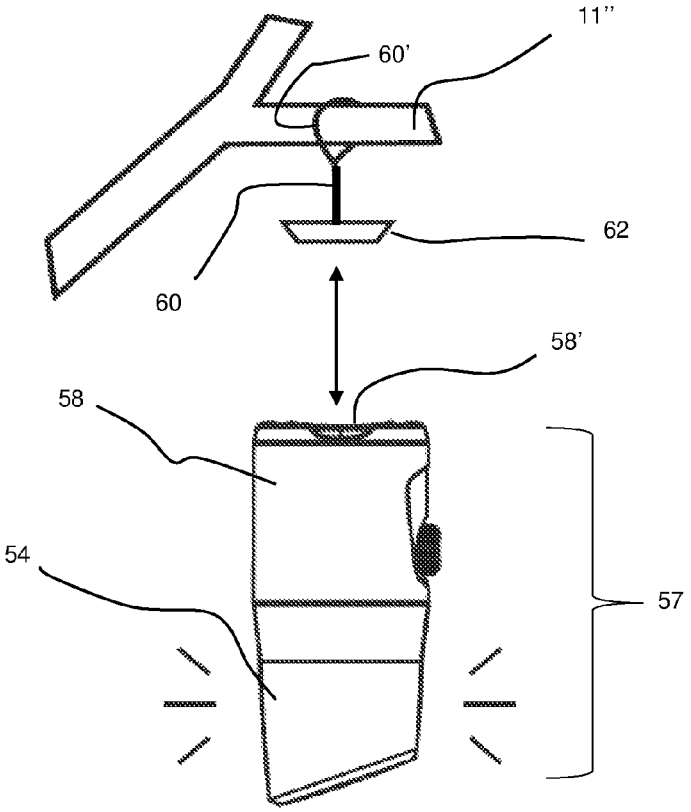
FIG. 9 is a simplified illustration of the magnet member of FIG. 8 attached to an object by a lanyard that is fixedly attached to the magnet member, and further illustrating that a bottom surface section of the body of the portable lighting device of FIG. 7 is magnetically attracted to the magnet member sufficiently to hang the body portion from the magnet member.

Referring to FIGS. 7-9, in an alternative embodiment of the present disclosure, a portable lighting device 52, such as a lantern, having a translucent globe 54 (or lens) housing a light source within, such as an LED light source (not illustrated), can include a base 58. Similar to the embodiments described supra, the base 58 can include a power actuating member, such as a knob 64 (or button) for activating the light source, to use the lantern. In some embodiments, the knob 64 is rotatable to turn the light source on and off, and to adjust light intensity of the light source (and/or to change a mode of light distribution) and the power source and electrical components of the portable lighting device 52 can be contained within the base 58, with the light source being disposed at a top portion of the base 58 within the translucent globe 54.

Still referring to FIGS. 7-9, a detachable magnet member 62 can be provided and configured for attachment to a bottom surface section 58' of the base 58 by magnetism. In some embodiments, the base 58 has a generally cylindrical shape, and the detachable magnet member 62, can be disc-like in appearance, with a generally circular lateral perimeter. The magnet member 62 can contain/comprise a magnet (e.g., permanent magnet), or be composed of a ferromagnetic material, or the bottom surface section 58' can contain a magnet or be composed of a ferromagnetic material, and in any case, the bottom surface section 58' and detachable magnet member 62 are configured to be magnetically attracted. The magnetic attraction between the bottom surface section 58' and magnet member 62 can be configured with sufficiently strong magnet force, such that a user can couple the magnet member 62 to an object 11" to hang the portable lighting device 52 from the object 11" without spontaneous detachment of the bottom surface section 58' from the magnet member 62. As such, in some embodiments, the magnetic force is configured to be strong enough to reliably retain the weight of the base and globe but still allow easy manual detachment of the base and globe from the magnet member 62 by a user simply pulling the base/globe away from the magnet member 62.

As best seen in FIGS. 8 & 9, a lanyard 60, such as, for example, a flexible and/or elastic lanyard having a free closed loop portion 60', can be fixedly attached to the magnet member 62 at an end portion thereof. The magnet member 62 can be attached to an object 11" by the lanyard 60 in a variety of manners, such as, for example, forming an overlapping loop connection (similar to overlapping loop connection 40' described above in relation to the rigid ring 41), or otherwise, threading an object 11' through the free closed loop portion 60' if a termination point of the object is accessible. In any case, the magnet member 62 can be much smaller than the lighting device 52, and much easier to manipulate for attaching it to an object using lanyard 60. Thereafter, the body 57 (base 58 and globe 54 portion) of the portable lighting device 52 can be quickly and conveniently attached to the magnet member 62 (or easily detached therefrom) by magnetic attraction between the hanging magnet member 62 and the bottom surface section 58' of the base 58. Thereafter, the body 57 can be hung from the object 11" during use of the portable lighting device 52 with the light source turned on.

When the magnet member 62 is not in use, it can be easily stored with the body 57 of the portable lighting device by magnetically attaching it to the bottom surface section 58'. In some embodiments, the bottom surface section 58' is formed on a surface that is recessed upwardly (in relation to FIG. 7) relative to a bottommost surface 58" of the base 58. In some embodiments, when the magnet member 62 is attached to the bottom surface section 58', a bottommost surface 62' of the magnet member 62 is disposed above the bottommost surface 58" of the base 58 so that when the base 58 is placed on a resting surface, the magnet member 62 completely clears the surface and is not displaced from its magnetic attachment with the bottom surface section 58'.

After reviewing the present disclosure, an individual of ordinary skill in the art will immediately appreciate that some details and features can be added, removed and/or changed without deviating from the spirit of the invention. Reference throughout this specification to "one embodiment," "an embodiment," "some embodiments," and/or "alternative embodiment(s)," means that a particular feature, structure or characteristic described in connection with the embodiment(s) is included in at least one or some embodiment(s), but not necessarily all embodiments, such that the references do not necessarily refer to the same embodiment (s). Furthermore, the particular features, structures, or characteristics from the various embodiments described herein may be combined in any suitable manner in one or more embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. As such, in the following claims, the terms used should not be construed to limit the disclosure to the specific embodiments disclosed in the specification.

What is claimed is:

1. A portable lighting device comprising:

a light source;

a body having a base and a lens or globe; and an elastic lanyard anchored to a disc-shaped magnet member, the disc-shaped magnet member being magnetically attached to a bottom surface section of the base.

2. The portable lighting device of claim 1 wherein the elastic lanyard extends from the disc-shaped magnet member in closed loop fashion.

3. The portable lighting device of claim 1 wherein a bottommost surface of the base extends below the bottom surface section.

4. The portable lighting device of claim 3 wherein the bottom surface section is disposed radially inward of the bottommost surface of the base.

5. A method of attaching a portable lighting device to an object comprising:

attaching a lanyard to an object, the lanyard being coupled to a member that is magnetically attracted to a body portion of the portable lighting device; and magnetically attaching a bottom of the body portion of the portable lighting device opposite a globe of the portable lighting device, to the member to hang the portable lighting device.

* * * * *